US011873812B2

(12) United States Patent
Raatschen et al.

(10) Patent No.: US 11,873,812 B2
(45) Date of Patent: Jan. 16, 2024

(54) ROTARY PUMP COMPRISING AN ADJUSTING DEVICE

(71) Applicant: Schwäbische Hüttenwerke Automotive GmbH, Aalen (DE)

(72) Inventors: Moritz Raatschen, Bad Schussenried (DE); Thomas Finsterle, Ravensburg (DE); Fabian Eisele, Herbertingen (DE); Gerd Jäggle, Ertingen (DE)

(73) Assignee: Schwäbische Hüttenwerke Automotive GmbH, Aalen (DE)

( * ) Notice: Subject to any disclaimer, the term of this patent is extended or adjusted under 35 U.S.C. 154(b) by 0 days.

(21) Appl. No.: 17/957,449

(22) Filed: Sep. 30, 2022

(65) Prior Publication Data

US 2023/0105862 A1 Apr. 6, 2023

(30) Foreign Application Priority Data

Oct. 4, 2021 (DE) ..... 10 2021 125 709.3

(51) Int. Cl.
*F03C 2/00* (2006.01)
*F03C 4/00* (2006.01)
(Continued)

(52) U.S. Cl.
CPC ..... *F04C 14/226* (2013.01); *F04C 2/344* (2013.01); *F04C 2/3441* (2013.01)

(58) Field of Classification Search
CPC ..... F04C 2/344; F04C 2/3441; F04C 2/3442; F04C 14/223; F04C 14/226; F04C 15/06; F01C 21/106
See application file for complete search history.

(56) References Cited

U.S. PATENT DOCUMENTS 4,437,819 A * 3/1984 Merz ..... F04C 14/226 418/27
8,814,544 B2 8/2014 Ebinger et al.
(Continued)

FOREIGN PATENT DOCUMENTS

DE 102011011690 A1 8/2012
DE 102011086175 B3 5/2013
(Continued)

OTHER PUBLICATIONS

German Search Report issued in German Patent Application No. 10 2021 125 709.3 dated Jun. 2, 2022, 7 pages, with partial English translation.

(Continued)

*Primary Examiner* — Theresa Trieu
(74) *Attorney, Agent, or Firm* — RatnerPrestia

(57) ABSTRACT

A rotary pump includes: a pump housing having a low-pressure inlet and a high-pressure outlet; a delivery rotor rotatable about a rotational axis and including multiple deliverers distributed over the circumference of the rotor for delivering a fluid from the low-pressure inlet to the high-pressure outlet; and a setting element for adjusting the delivery volume of the pump. The inlet end of the setting element includes a first circumferential portion which extends circumferentially in the rotational direction of the rotor and the axial width of which is smaller than the axial width of the deliverers and a second circumferential portion which adjoins the first circumferential portion in the rotational direction and the axial width of which is greater than the axial width of the first circumferential portion.

16 Claims, 6 Drawing Sheets

(51) Int. Cl.

| | |
|---|---|
| ***F04C 2/00*** | (2006.01) |
| ***F04C 2/067*** | (2006.01) |
| ***F04C 14/22*** | (2006.01) |
| ***F04C 2/344*** | (2006.01) |

(56) References Cited

U.S. PATENT DOCUMENTS

| | | | | |
|---|---|---|---|---|
| 2012/0213654 | A1 | 8/2012 | Zwickler et al. | |
| 2013/0121867 | A1 | 5/2013 | Ebinger et al. | |
| 2016/0177948 | A1* | 6/2016 | Braasch | F04C 14/226 418/27 |
| 2017/0268508 | A1* | 9/2017 | Merk | F01C 21/0809 |

FOREIGN PATENT DOCUMENTS

| | | | |
|---|---|---|---|
| DE | 102020119893 | A1 | 2/2022 |
| EP | 2865920 | A1 | 4/2015 |
| EP | 3279477 | A1 | 2/2018 |
| GB | 2488206 | A | 8/2012 |

OTHER PUBLICATIONS

Extended European Search Report for EP Application No. 22198807.4, dated Mar. 2, 2023, with translation, 11 pages.

* cited by examiner

ROTARY PUMP COMPRISING AN ADJUSTING DEVICE

CROSS REFERENCE TO RELATED APPLICATIONS

This application claims benefit of priority to German Patent Application No. 10 2021 125 709.3, filed Oct. 4, 2021. The contents of this application are incorporated herein by reference.

FIELD OF THE INVENTION

The invention relates to a rotary pump having an adjustable delivery volume. The rotary pump comprises a pump housing having a low-pressure inlet and a high-pressure outlet. A delivery rotor which can be rotated about a rotational axis is arranged within the pump housing. The delivery rotor comprises multiple delivery means in order to deliver a fluid to be delivered from the low-pressure inlet to the high-pressure outlet. The delivery means, which are distributed over the circumference of the delivery rotor, can in particular be radially movable in relation to the rotational axis of the delivery rotor. For adjusting the delivery volume of the rotary pump, a translationally movable setting element is arranged in the pump housing. Preferably, an inner surface area of the setting element delineates the movement of the delivery means radially outwards.

BACKGROUND OF THE INVENTION

Rotary pumps having an adjustable delivery volume are known from the prior art, in which the setting element for adjusting the delivery volume is arranged in the pump housing such that it can rotate and/or pivot in relation to the rotational axis of the delivery rotor, wherein the inner surface area of the setting element delineates a delivery region of the rotary pump on the radially outer side. The setting elements of these known rotary pumps have necessarily comprise circumferential portions which are arranged in the low-pressure inlet in any position of the setting element. There is always a circumferential portion of the setting element arranged radially between the delivery rotor, in particular the delivery region, and the fluid flowing in through the low-pressure inlet. In order to nonetheless be able to ensure a radial inflow and/or supply of fluid to the delivery region, said circumferential portions regularly exhibit an axial width which is smaller than the axial width of the delivery means.

The rotary pumps known from the prior art have the disadvantage that the radial inflow decreases in the rotational direction of the delivery rotor. The is due to the fact that fluid flowing into the delivery region is carried off in the circumferential direction and accelerated, such that it is exposed to a centrifugal force which increases in the rotational direction of the delivery rotor and presses it radially outwards. This effect has a negative influence on the delivering characteristics. It can even occur that some of the fluid flows radially outwards back into the low-pressure inlet. This unwanted effect is mainly dependent on the rotational speed of the delivery rotor and occurs in all positions of the setting element and is in particular disruptive in positions of maximum delivery volume.

SUMMARY OF THE INVENTION

An aspect of the invention is a rotary pump which exhibits improved delivery characteristics and which can be manufactured cost-effectively.

The rotary pump in accordance with an aspect of the invention comprises a pump housing having a low-pressure inlet and a high-pressure outlet for a fluid to be delivered. A delivery rotor which can be rotated about a rotational axis is arranged within the pump housing. The delivery rotor comprises multiple delivery means which are distributed over the circumference of the delivery rotor and can for example be movable, radially or with a radial direction component, in relation to the rotational axis of the delivery rotor. The delivery means can be arranged on a rotor base body of the delivery rotor. For adjusting the delivery volume of the rotary pump, the rotary pump comprises a setting element which can be translationally moved back and forth in relation to the pump housing.

A "translational movement" is understood to mean a change in the position of the corresponding component in relation to the pump housing, in which all the constituent parts of the component experience the same shift, i.e. exhibit the same velocity vector and/or acceleration vector at a given point in time.

A "rotary movement" or "rotational movement" is understood to mean a change in the position of the corresponding component in relation to the pump housing, in which all the constituent parts of the component are moved circularly about a common axis.

Preferably, a delivery region of the rotary pump is radially delineated by an outer surface area of the rotor, in particular an outer surface area of the rotor base body, and an inner surface area of the setting element. The delivery region can be axially defined by the axial extent of the delivery means. Within the delivery region, a delivery cell can be formed by two respectively adjacent delivery means together with the outer surface area of the rotor, in particular the outer surface area of the rotor base body, and the inner surface area of the setting element. The cell volume of a delivery cell preferably changes while the rotary pump is in operation (while the delivery rotor is rotating). The delivery region can comprise a low-pressure region and a high-pressure region. The low-pressure region is for example defined by the cell volume of the delivery cells increasing in the rotational direction of the delivery rotor. The high-pressure region is for example defined by the cell volume of the delivery cells decreasing in the rotational direction of the delivery rotor.

The low-pressure inlet preferably extends from a fluid port on the outer wall of the pump housing up to or into the delivery region, in particular up to or into the low-pressure region. The fluid to be delivered can be fed to the delivery region via the low-pressure inlet. Irrespective of this, the low-pressure inlet can comprise multiple sub-portions. An inlet channel can for example adjoin the fluid port in the flow direction of the fluid to be delivered. The inlet channel advantageously extends from the fluid port up to an outer surface area of the setting element. The inlet channel can be a passage or channel in the pump housing. From the outer surface area of the setting element, the inlet channel can transition into a feed portion. The feed portion can comprise one or more sub-channels and/or pockets and/or recesses and/or nodules in the pump housing. These preferably enable an axial supply of the fluid to the low-pressure region of the delivery region. Irrespective of this, the feed portion can also comprise cavities and/or recesses in other components of the rotary pump, such as for example the setting element, in order to enable a supply, in particular a radial supply, of fluid to the delivery region, in particular the low-pressure region.

The high-pressure outlet extends from the delivery region, in particular from the high-pressure region, up to a fluid outlet on the outer wall of the pump housing. The delivered fluid can be discharged from the delivery region, in particular from the high-pressure region, through the high-pressure outlet. Irrespective of this, the high-pressure outlet can comprise multiple sub-portions. An outlet portion can for example adjoin the delivery region, in particular the high-pressure region, in the flow direction of the fluid to be delivered. The outlet portion can be formed by one or more sub-channels, pockets, recesses and/or nodules in the pump housing. These preferably enable an axial discharge of the delivered fluid from the delivery region, in particular from the high-pressure region. Irrespective of this, the outlet portion can also comprise cavities and/or recesses in other components of the rotary pump, such as for example the setting element, in order to enable a discharge, in particular a radial discharge, of the fluid from the delivery region, in particular from the high-pressure region. From the outer surface area of the setting element, the outlet region can transition into an outlet channel. The outlet channel advantageously extends from the outer surface area of the setting element up to the fluid outlet. The outlet channel can be a passage or channel in the pump housing.

The setting element, which can be translationally moved back and forth in relation to the pump housing, can in particular be translationally moved back and forth between a first position and a second position. The rotary pump preferably exhibits a maximum delivery volume in the first position. The rotary pump preferably exhibits a minimum delivery volume in the second position. The setting element can consist of one part. It is preferably molded in one piece.

The setting element comprises a first circumferential portion and a second circumferential portion at the inlet end, i.e. for example facing the low-pressure inlet, in particular the inlet channel. Both circumferential portions extend circumferentially in the rotational direction of the delivery rotor, wherein the second circumferential portion adjoins the first circumferential portion, preferably directly, in the rotational direction of the delivery rotor. The first circumferential portion exhibits an axial width which is smaller than the axial width of the delivery means. In accordance with an aspect of the invention, the second circumferential portion exhibits an axial width which is greater than the axial width of the first circumferential portion. The axial width of the second circumferential portion can nonetheless be smaller than the axial width of the delivery means. Preferably, however, the axial width of the second circumferential portion corresponds at least substantially to the axial width of the delivery means. At this juncture, the term "substantially" shall be understood to mean a permissible deviation which does not exceed the manufacturing tolerances and which is in particular less than 0.5 mm.

The first circumferential portion and the second circumferential portion can at least partially radially delineate the delivery region, in particular the low-pressure region, in any position of the setting element. In an example embodiment, the first circumferential portion is at least partially arranged radially between the delivery rotor and the inlet channel of the low-pressure inlet in any position of the setting element. Alternatively, or additionally, the second circumferential portion is at least partially arranged radially between the delivery rotor and the inlet channel of the low-pressure inlet in any position of the setting element. In a particularly advantageous embodiment, both the first circumferential portion and the second circumferential portion are arranged at least partially, and preferably completely over their respective circumferential extent, radially between the delivery rotor and the inlet channel of the low-pressure inlet in any position of the setting element.

The descriptor "any position of the setting element" includes the first position, the second position and any other position between the first position and the second position which the setting element can assume.

In advantageous embodiments, the delivery region, in particular the low-pressure region of the delivery region, is connected in direct fluid communication with the low-pressure inlet, in particular the inlet channel, via the first circumferential portion in the radial direction. This fluid-communicating connection between the delivery region, in particular the low-pressure region, and the low-pressure inlet, in particular the inlet channel, is preferably provided in any position of the setting element. Alternatively, or additionally, direct fluid communication between the delivery region, in particular the low-pressure region of the delivery region, and the low-pressure inlet, in particular the inlet channel, is prevented by the second circumferential portion in the radial direction. Fluid communication between the delivery region, in particular the low-pressure region of the delivery region, and the low-pressure inlet, in particular the inlet channel, is advantageously prevented by the second circumferential portion in any position of the setting element. This embodiment has the advantage that the fluid which has already been fed to the delivery region, in particular the low-pressure region of the delivery region, via the first circumferential portion cannot be pressed radially outwards back out of the delivery region via the second circumferential portion by the centrifugal force.

The first circumferential portion can be provided at the beginning of the low-pressure region in the rotational direction of the delivery rotor. The first circumferential portion preferably extends over less than 70% of the circumferential extent of the low-pressure region in any position of the setting element. The first circumferential portion particularly preferably extends over less than 60% of the circumferential extent of the low-pressure region in any position of the setting element. The extent of the first circumferential portion as measured in the circumferential direction can be greater than the maximum circumferential extent of two adjacent delivery cells. In other words, the extent of the first circumferential portion as measured in the circumferential direction is preferably greater than the maximum circumferential distance between the two outermost delivery means of a total of three adjacent delivery means. Irrespective of this, the extent of the first circumferential portion as measured in the circumferential direction can be smaller than the maximum circumferential extent of three adjacent delivery cells. The extent of the first circumferential portion as measured in the circumferential direction is advantageously smaller than the maximum circumferential distance between the two outermost delivery means of a total of four adjacent delivery means.

The second circumferential portion can extend up to the end of the low-pressure region in the rotational direction of the delivery rotor, and in principle beyond the low-pressure region, as long as the delivery cells do not increase in size again. The second circumferential portion preferably extends over more than 30% of the circumferential extent of the low-pressure region in any position of the setting element. The second circumferential portion particularly preferably extends over more than 40% of the circumferential extent of the low-pressure region in any position of the setting element. The extent of the second circumferential portion as measured in the circumferential direction can be greater than the maximum circumferential extent of a delivery cell. In other words, the extent of the second circumferential portion as measured in the circumferential direction is preferably greater than the maximum circumferential distance between two adjacent delivery means. Irrespective of this, the extent of the second circumferential portion as measured in the circumferential direction can be smaller than the maximum circumferential extent of two adjacent delivery cells. The extent of the second circumferential portion as measured in the circumferential direction is preferably smaller than the maximum circumferential distance between the two outermost delivery means of a total of three adjacent delivery means.

A transition from the first circumferential portion to the second circumferential portion is arranged in the low-pressure inlet in any position of the setting element. The transition can for example be a collar of the setting element which is parallel to the rotational axis of the delivery rotor. In this embodiment, the transition exhibits almost no extent in the circumferential direction. Alternatively, the transition can also be embodied as a ramp. In other words, the transition from the first circumferential portion to the second circumferential portion can be formed by an increase in the axial width of the setting ring in the rotational direction of the delivery rotor. In this embodiment, the transition does exhibit an extent in the circumferential direction. The transition can be embodied to be linear, concave and/or convex. A transition which is short in the circumferential direction—most preferably, a stepped transition—is preferred.

For translationally adjusting the setting element, the setting element can comprise multiple sliding surfaces. Each sliding surface of the setting element preferably abuts a corresponding sliding surface of the pump housing. If the setting element is adjusted, the sliding surfaces of the setting element can slide along corresponding sliding surfaces of the pump housing in order to enable and advantageously guide translational movements of the setting element in relation to the pump housing.

In an example development, at least two sliding surfaces of the setting element are embodied as sealing sliding surfaces. Each of the sealing sliding surfaces can comprise at least one sealing edge which faces the low-pressure inlet. Advantageously, the respective sealing edges seal off the low-pressure inlet in the sliding contact between the pump housing and the setting element. The setting element can for example comprise a first sealing sliding surface which is provided next to the first circumferential portion in the circumferential direction, in particular counter to the rotational direction of the delivery rotor. The setting element can additionally comprise a second sealing sliding surface which is provided next to the second circumferential portion in the circumferential direction, in particular in the rotational direction of the delivery rotor. Irrespective of this, the first sealing sliding surface advantageously comprises a first sealing edge. The second sealing sliding surface can comprise a second sealing edge.

The first sealing sliding surface can define a first imaginary plane. The first imaginary plane can for example be spanned by the first sealing edge of the first sealing sliding surface and another edge of the first sealing sliding surface which is orthogonal to the first sealing edge. The second sealing sliding surface can define a second imaginary plane. The second imaginary plane can for example be spanned by the second sealing edge of the second sealing sliding surface and another edge of the second sealing sliding surface which is orthogonal to the second sealing edge. Advantageously, the first imaginary plane is aligned in parallel with the second imaginary plane. The first imaginary plane can be offset in parallel with respect to second imaginary plane or aligned congruently with the second imaginary plane.

In an example embodiment, the first imaginary plane extends between the rotational axis of the delivery rotor and the transition of the setting element in any position of the setting element. The transition is preferably neither intersected by nor tangent to the first imaginary plane. Irrespective of this, the second imaginary plane can extend between the rotational axis of the delivery rotor and the transition in any position of the setting element. The transition is preferably neither intersected by nor tangent to the second imaginary plane. In an example development, both imaginary planes extend between the rotational axis of the delivery rotor and the transition. The transition is advantageously neither intersected by or tangent to either the first imaginary plane or the second imaginary plane.

The transition can exhibit a distance from the first sealing edge as measured in the circumferential direction, in particular counter to the rotational direction of the delivery rotor. This distance can be greater than or equal to a distance from the second sealing edge as measured in the circumferential direction, in particular in the rotational direction of the delivery rotor. The distance between the transition and the first sealing edge as measured in the circumferential direction, in particular counter to the rotational direction of the delivery rotor, is preferably greater than the distance between the transition and the second sealing edge as measured in the circumferential direction, in particular in the rotational direction of the delivery rotor.

The distance between the transition and the first sealing edge as measured in the circumferential direction, in particular counter to the rotational direction of the delivery rotor, can be greater than the maximum circumferential extent of two adjacent delivery cells. In other words, the distance between the transition and the first sealing edge as measured in the circumferential direction, in particular counter to the rotational direction of the delivery rotor, is preferably greater than the maximum circumferential distance between the two outermost delivery means of a total of three adjacent delivery means. Irrespective of this, the distance between the transition and the first sealing edge as measured in the circumferential direction, in particular counter to the rotational direction of the delivery rotor, can be smaller than the maximum circumferential extent of three adjacent delivery cells. The distance between the transition and the first sealing edge as measured in the circumferential direction, in particular counter to the rotational direction of the delivery rotor, is preferably smaller than the maximum circumferential distance between the two outermost delivery means of a total of four adjacent delivery means.

The distance between the transition and the second sealing edge as measured in the circumferential direction, in particular in the rotational direction of the delivery rotor, can be greater than the maximum circumferential extent of a delivery cell. In other words, the distance between the transition and the second sealing edge as measured in the circumferential direction, in particular in the rotational direction of the delivery rotor, is preferably greater than the maximum circumferential distance between two adjacent delivery means. Irrespective of this, the distance between the transition and the second sealing edge as measured in the circumferential direction, in particular in the rotational direction of the delivery rotor, can be smaller than the maximum circumferential extent of two adjacent delivery cells. The distance between the transition and the second sealing edge as measured in the circumferential direction, in particular in the rotational direction of the delivery rotor, is preferably smaller than the maximum circumferential distance between the two outermost delivery means of a total of three adjacent delivery means.

The first circumferential portion can comprise an axial recess. The recess preferably extends over the entire radial width of the first circumferential portion. The circumferential extent of the first circumferential portion can be defined by the circumferential extent of the recess. The recess preferably comprises a recess base which is delineated in the circumferential direction by two recess walls. One of the recess walls can be formed by the transition.

In an example development, the second circumferential portion comprises a cavity. The cavity is preferably open radially inwards, towards the delivery rotor. The cavity is preferably not continuous in the radial and/or axial direction. In other words, the cavity does not extend over the entire axial and/or radial width of the second circumferential portion. The cavity can extend in the circumferential direction, in particular counter to the rotational direction of the delivery rotor, up to the first circumferential portion. In the opposite circumferential direction, in particular in the rotational direction of the delivery rotor, the cavity is advantageously delineated by a wall of the setting element. The extent of the cavity starting from the first circumferential portion and measured in the circumferential direction, in particular in the rotational direction of the delivery rotor, can be smaller than or equal to a maximum circumferential distance between two adjacent delivery means, but is preferably greater than a maximum circumferential distance between two adjacent delivery means.

While the rotary pump is in operation, the fluid to be delivered can for example flow from the low-pressure inlet into the cavity via the first circumferential portion. The cavity can be embodied such that the fluid situated in the cavity exhibits a flow direction which is tangential in relation to the delivery rotor. Advantageously, the delivery means which rotate past the cavity indirectly accelerate the fluid situated in the cavity in the rotational direction of the delivery rotor. The fluid accelerated in the circumferential direction in the cavity can then be introduced into the delivery region, in particular into the low-pressure region, via the delineating wall. Advantageously, indirect fluid communication between the low-pressure inlet, in particular the inlet channel, and the delivery region, in particular the low-pressure region, is achieved via the cavity of the second circumferential portion.

The cavity is radially delineated by an outer wall of the second circumferential portion, such that fluid flowing tangentially into the cavity can be accelerated along the outer wall in the circumferential direction, but not pressed back into the low-pressure inlet. In the region of the outer wall, the setting element can exhibit an axial width which corresponds to the axial width of the delivery means, as is preferred. The outer wall can however also in principle exhibit an axial width which is smaller than the axial width of the delivery means. The axial width of the outer wall is however greater than the axial width of the first circumferential portion of the setting element. The setting element can comprise a depression from the radially outer side inwards over the length of the second circumferential portion as measured in the circumferential direction, such that the setting element drops incrementally from the axial width of the outer wall to the comparatively smaller axial width of the cavity. Although this profile is preferred, the setting element can however in principle instead drop from the radially outer side inwards in the shape of a ramp or obliquely or in a convexly or concavely rounded curve in the second circumferential portion.

In advantageous embodiments, the rotary pump can comprise a flow channeling structure in order to influence and in particular redirect the fluid flowing in the low-pressure inlet. The flow channeling structure preferably protrudes axially from the pump housing into the low-pressure inlet. It can in particular be a structure of the pump housing. The flow channeling structure can be embodied to taper, in the shape of a wedge or conically, counter to the flow direction of the fluid in the low-pressure inlet. Advantageously, the flow channeling structure directs a first sub-flow of the fluid flow in the low-pressure inlet in such a way that the first sub-flow exhibits a main flow direction, when passing the setting element, which is directed counter to the rotational direction of the delivery rotor. Alternatively, or additionally, the flow channeling structure can be shaped such that a second sub-flow of the fluid flow in the low-pressure inlet exhibits a main flow direction, when passing the setting element, which corresponds to the rotational direction of the delivery rotor. Irrespective of this, the flow channeling structure can be shaped such that the first sub-flow of the fluid flow in the low-pressure inlet is directed towards the first circumferential portion. Alternatively, or additionally, the flow channeling structure can be shaped such that the second sub-flow of the fluid flow in the low-pressure inlet is directed towards the second circumferential portion. The flow channeling structure, if provided, thus sub-divides the low-pressure inlet into a first inlet sub-channel, which channels the fluid to the first circumferential portion of the setting element, and a second inlet sub-channel which channels the fluid to the second circumferential portion of the setting element.

As already explained, the transition from the first circumferential portion to the second circumferential portion is arranged in the low-pressure inlet in any position of the setting element. If the rotary pump comprises the flow channeling structure, the transition can advantageously be arranged next to the flow channeling structure in the region of the second inlet sub-channel in an axial plan view onto the flow channeling structure in any position of the setting element.

The setting element forms an axial sealing gap with axially facing end faces of the pump housing on each of the two end sides of the setting element, wherein the axial sealing gap seals the delivery region radially outwards over the circumference of the setting element within the scope of the setting element's ability to move.

The pump housing can comprise one or more axial recesses in the region of the low-pressure inlet. The respective housing recess axially widens the low-pressure inlet. The respective housing recess can extend on the facing end side of the setting element below the setting element into the low-pressure region of the delivery region, into an inlet nodule which is optionally provided therein and which can extend as an axial housing recess axially next to and in this sense below the delivery elements in the circumferential direction. In such embodiments, the fluid flows in the respective housing recess, past the setting element, into the inlet nodule. The inlet nodule, if provided, can extend in the circumferential direction along the first circumferential portion of the setting element and/or along the second circumferential portion of the setting element.

If the inlet nodule extends along the first circumferential portion, and a housing recess of the low-pressure inlet extends into the inlet nodule on an end side of the setting element below the first circumferential portion, fluid in the housing recess can flow past the first circumferential portion into the inlet nodule and from there axially into the delivery region.

If the inlet nodule extends along the second circumferential portion, and a housing recess of the low-pressure inlet extends into the inlet nodule on an end side of the setting element below the second circumferential portion, fluid can flow past the second circumferential portion into the inlet nodule and from there axially into the delivery region. If the axial width of the second circumferential portion of the setting element corresponds to the width of the delivery means in such embodiments, the setting element does prevent a radial flow into the delivery region in its second circumferential portion, but fluid can flow from the side via the part of the inlet nodule extending along the second circumferential portion and thus flow axially into the delivery region in such embodiments. If the axial width of the second circumferential portion of the setting element is smaller than the width of the delivery means, but greater than the axial width of the first circumferential portion, a radial inflow via the second circumferential portion is at least throttled as compared to the first circumferential portion. The axial width which in accordance with an aspect of the invention is greater than that of the first circumferential portion at least counteracts a backflow due to centrifugal force in the second circumferential portion.

The rotary pump can in particular be designed for use in a motor vehicle. The rotary pump can accordingly be embodied as a motor vehicle pump. The rotary pump is preferably designed for delivering a liquid, in particular a lubricant, coolant and/or actuating medium. The rotary pump can accordingly be embodied as a liquid pump. The rotary pump is preferably designed for supplying and/or lubricating and/or cooling a drive motor and/or a transmission of a motor vehicle. The liquid is preferably an oil, for example an engine lubricating oil or a transmission oil. The rotary pump can in particular be embodied as an engine lubricant pump for a motor vehicle and/or as a transmission pump for a motor vehicle.

BRIEF DESCRIPTION OF THE DRAWINGS

The features described above can be combined with each other as desired, wherever technically expedient and suitable. Other features, combinations of features and advantages of aspects of the invention follow from the following description of example embodiments on the basis of the figures. There is shown.

DETAILED DESCRIPTION OF THE INVENTION

Figure 1:
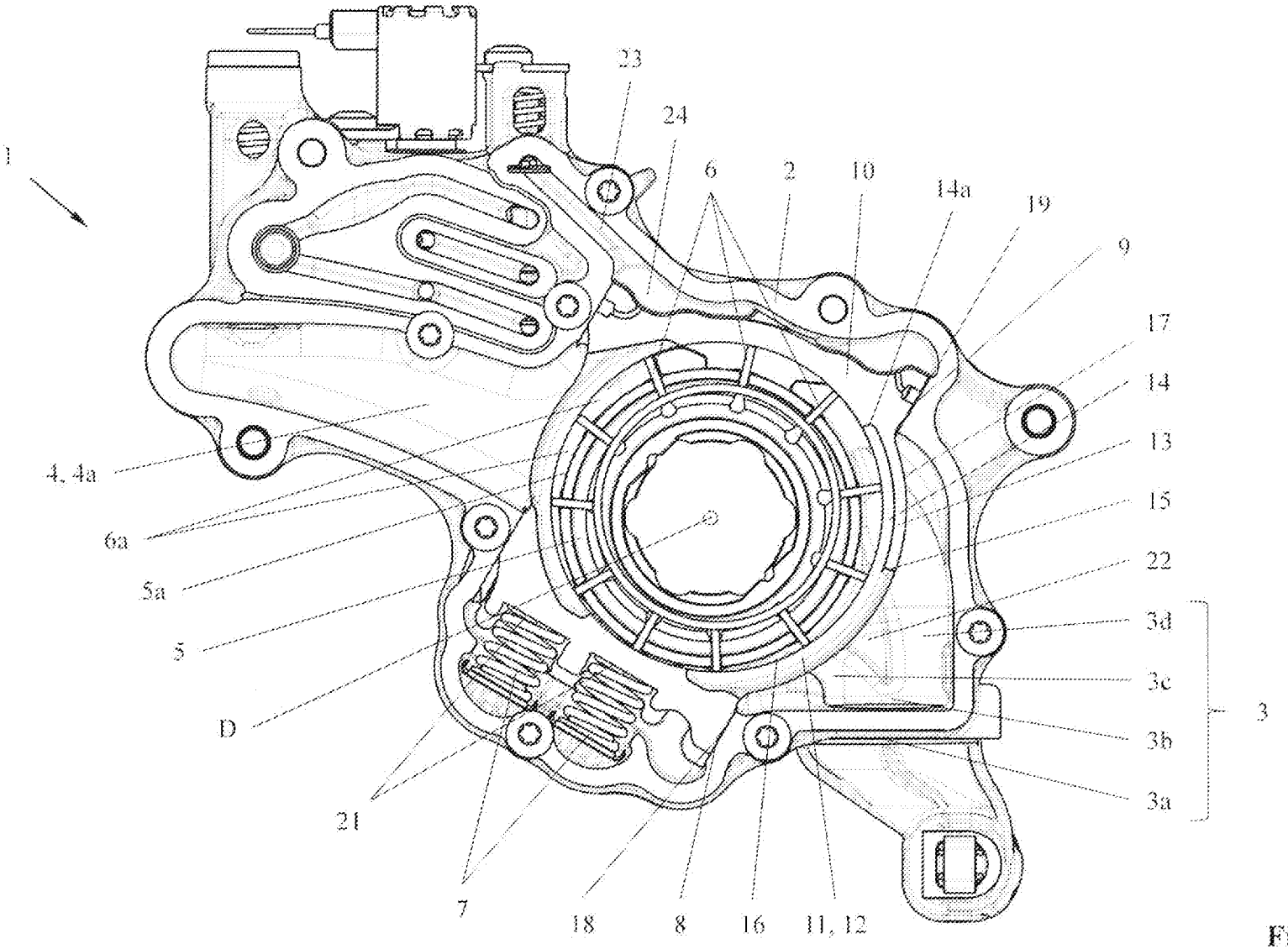
FIG. 1 a sectional representation of an example embodiment of the rotary pump in accordance with the invention.

FIG. 1 is a sectional representation of an example embodiment of the rotary pump 1 in accordance with the invention. In the example embodiment, the rotary pump 1 is embodied as a vane pump. The rotary pump 1 comprises a pump housing 2 comprising a low-pressure inlet 3 and a high-pressure outlet 4 for the fluid to be delivered. In order to channel the fluid to be delivered into the interior of the rotary pump 1, the low-pressure inlet 3 comprises a fluid port 3*a* on an outer wall of the pump housing 2. The fluid port 3*a* forms an inlet intersection for an inlet channel 3*b* of the low-pressure inlet 3. The inlet channel 3*b* extends from the fluid port 3*a* into the pump housing 2. Similarly, the high-pressure outlet 4 comprises an outlet channel 4*a* in order to channel the fluid out of the rotary pump via a fluid port (not shown) of the high-pressure outlet 4.

A delivery rotor 5, which can be rotated about a rotational axis D, is arranged within the pump housing 2. The delivery rotor 5 is axially delineated by the pump housing 2. Multiple delivery means 6 are distributed over the circumference of the delivery rotor 5. In the example embodiment shown, the delivery means 6 can be moved back and forth radially outwards and inwards in relation to the rotational axis D. The delivery means 6 are arranged at equal distances from each other in the circumferential direction. Alternatively, or additionally, the delivery means 6 can be arranged at different distances from each other in the circumferential direction, at least in portions. The movement of the delivery means 6 is delineated radially inwards by the delivery rotor 5. The movement of the delivery means 6 outwards, away from the rotational axis D, is delineated by an inner surface area 16 of a setting element 10.

While the rotary pump 1 is in operation, the delivery rotor 5 rotates about the rotational axis D, wherein the delivery means 6 are pressed radially outwards towards the inner surface area 16 of the setting element 10 by the centrifugal force acting on the delivery means 6. The axial outer edges of the delivery means 6, together with the outer surface area 5*a* of the delivery rotor 5 and the inner surface area 16 of the setting element 10, define a delivery region. The delivery region is thus an annular volume, the axial width of which corresponds to the width of the delivery means 6. Within the delivery region, each two adjacent delivery means 6 form a delivery cell 6*a*. The fluid to be delivered is supplied to the delivery region and/or the delivery cells 6*a* via the low-pressure inlet 3, in particular via the fluid port 3*a* and the inlet channel 3*b*. In the delivery region, the fluid to be delivered is delivered from the low-pressure inlet 3 to the high-pressure outlet 4, in particular to the outlet channel 4*a*. The fluid to be delivered is delivered from the low-pressure inlet 3 to the high-pressure outlet 4, through the delivery region, in the delivery cells 6*a* due to the direct influence of the rotating delivery means 6.

The setting element 10, the detailed structure of which is described in more detail further below and on the basis of FIGS. 3 to 6, is embodied to alter and/or adjust the delivery volume of the rotary pump 1. For this purpose, the setting element 10 can be moved back and forth between at least two positions in relation to the pump housing 2. In the example embodiment, the setting element 10 can be translationally moved, i.e. the setting element 10 is arranged such that it can be shifted in the pump housing 2. The inner surface area 16 of the setting element 10 extends around a central axis (not shown) which is offset in parallel in relation to the rotational axis D of the delivery rotor 5 when the setting element 10 is in a first position. Because the central axis of the setting element 10 is offset in parallel in relation to the rotational axis D of the delivery rotor 5, the setting element 10 exhibits an eccentricity in relation to the delivery rotor 5. FIG. 1 shows the setting element 10 in its first position.

In the first position, the delivery region comprises a low-pressure region in which the volume of the delivery cells 6*a* increases in the rotational direction of the delivery rotor 5. When the setting element 10 is in its first position, the delivery region also comprises a high-pressure region which adjoins the low-pressure region in the rotational direction of the delivery rotor 5. In the high-pressure region, the volume of the delivery cells 6*a* decreases in the rotational direction of the delivery rotor 5. The rotary pump 1 exhibits a maximum delivery volume in the first position.

In a second position (not shown), the setting element 10 is shifted in the pump housing 2 such that the setting element 10 exhibits a minimum eccentricity or no eccentricity in relation to the delivery rotor 5. In other words, the central axis of the setting element 10 is substantially or almost coaxial with the rotational axis D of the delivery rotor 5 in the second position. The rotary pump 1 exhibits a minimum delivery volume in the second position.

The first position and second position are preferably end positions of the setting element 10, i.e. the setting element 10 cannot assume a position in which it exhibits a greater eccentricity in relation to the delivery rotor 5 than in the first position and/or a smaller eccentricity in relation to the delivery rotor 5 than in the second position. The setting element 10 can assume multiple intermediate positions, for example any number of intermediate positions, between the first position and the second position.

The rotary pump 1 comprises a restoring means 7 in order to press the setting element 10 into the first position. The restoring means 7 preferably exerts a restoring force on the setting element 10, wherein the restoring force presses the setting element 10 into the first position. In the example embodiment shown, the restoring means 7 comprises two restoring springs 7 which are supported on the one hand on the pump housing 2 and on the other hand on a respective pressure surface 21 of the setting element 10. In order to move the setting element 10 into the second position, the rotary pump 1 comprises a pressure channel 23 and a pressure chamber 24. The pressure chamber 24 extends between the pump housing 2 and the setting element 10. A pressurized fluid can be channeled into the pressure chamber 24 via the pressure channel 23. The fluid pressure thus prevailing in the pressure chamber 24 presses the setting element 10 towards the second position, against the restoring force of the restoring means 7. The pressurized fluid can for example be the delivered fluid, which is taken at a point of the high-pressure region still within the pump housing 2 or a point downstream of the high-pressure outlet 4.

At the inlet end, i.e. in the region of the low-pressure inlet 3, the setting element 10 comprises a first circumferential portion 11 and a second circumferential portion 13. Irrespective of this, the delivery region is delineated or surrounded on the radially outer side, at least in portions, by the first circumferential portion 11 and the second circumferential portion 13. The second circumferential portion 13 adjoins the first circumferential portion 11 in the rotational direction of the delivery rotor 5. Both circumferential portions 11, 13 extend radially between the inner surface area 16 and an outer surface area 17 of the setting element 10.

The first circumferential portion 11 exhibits an axial width $B_1$ which is smaller than the axial width of the delivery means 6. In FIG. 13, one of the delivery means 6 of width $B_6$ is shown to the left of the setting element 10. The second circumferential portion 13 exhibits an axial width $B_2$ which is greater than the axial width $B_1$ of the first circumferential portion 11 (cf. FIGS. 3 and 5). The axial width $B_2$ of the second circumferential portion 13 preferably corresponds to the axial width $B_6$ of the delivery means 6.

An extent of the first circumferential portion 11 as measured in the circumferential direction is greater than or equal to the circumferential extent of the second circumferential portion 13. In the example embodiment shown in FIG. 1, the extent of the first circumferential portion 11 as measured in the circumferential direction is greater than the circumferential extent of the second circumferential portion 13.

As shown in FIG. 1, the extent of the first circumferential portion 11 as measured in the circumferential direction is greater than the maximum circumferential extent of two adjacent delivery cells 6*a*. In other words, the extent of the first circumferential portion 11 as measured in the circumferential direction is greater than the maximum circumferential distance between the two outermost delivery means 6 of a total of three adjacent delivery means 6. Irrespective of this, the extent of the first circumferential portion 11 as measured in the circumferential direction is smaller than the maximum circumferential extent of three adjacent delivery cells 6*a*. The extent of the first circumferential portion 11 as measured in the circumferential direction is smaller than the maximum circumferential distance between the two outermost delivery means 6 of a total of four adjacent delivery means 6.

The extent of the second circumferential portion 13 as measured in the circumferential direction is greater than the maximum circumferential extent of a delivery cell 6*a*. In other words, the extent of the second circumferential portion 13 as measured in the circumferential direction is greater than the maximum circumferential distance between two adjacent delivery means 6. Irrespective of this, the extent of the second circumferential portion 13 as measured in the circumferential direction is smaller than the maximum circumferential extent of two adjacent delivery cells 6*a*. The extent of the second circumferential portion 13 as measured in the circumferential direction is smaller than the maximum circumferential distance between the two outermost delivery means 6 of a total of three adjacent delivery means 6.

While the rotary pump 1 is in operation, the fluid to be delivered can flow around the first circumferential portion 11 in the radial direction in order to radially flow into the delivery region of the rotary pump 1. The delivery region of the rotary pump 1 is connected in direct fluid communication with the low-pressure inlet 3, in particular the inlet channel 3*a* of the low-pressure inlet 3, via the first circumferential portion 11 in the radial direction. The first circumferential portion 11 advantageously causes the delivery cells 6*a* to be optimally flooded with the fluid to be delivered at the beginning of the low-pressure region, in particular in a first portion of the low-pressure region.

The first circumferential portion 11 is formed by a recess 12, in particular an axial recess 12, in the setting element 10. The recess 12 is continuous in the radial direction.

The first circumferential portion 11 extends in the rotational direction of the delivery rotor 5 up to a transition 15. In the example embodiment, the transition 15 is a collar 15 and can in particular be a collar 15 which is parallel to the rotational axis D of the delivery rotor 5. The transition 15 connects the first circumferential portion 11 to the second circumferential portion 13. In other words, the transition 15 defines the boundary between the first circumferential portion 11 and the second circumferential portion 13. In the example embodiment shown, the transition 15 is arranged in the low-pressure inlet 3 in any position of the setting element 10. The transition 15 is arranged within the range of extent of the low-pressure inlet 3 as measured in the circumferential direction in any position of the setting element 10, and the fluid flowing in the low-pressure inlet 3 can preferably flow onto it in any position of the setting element 10. The transition 15 is arranged radially between the delivery rotor 5 and a portion of the low-pressure inlet 3, in particular the inlet channel 3*b*, in any position of the setting element 10.

The fluid to be delivered, which flows into the delivery cells 6*a* even at the beginning of the low-pressure region while the rotary pump 1 is in operation, is subjected to a centrifugal force which increases in the rotational direction of the delivery rotor 5 because it is carried off by the delivery means 6. This centrifugal force acting on the fluid causes the fluid to be pressed radially outwards with increasing force in the rotational direction of the delivery rotor 5. Further flooding of the delivery cells 6*a* from a radial direction is increasingly impeded in the rotational direction of the delivery rotor 5. Instead, the fluid even tends to be pressed back out of the delivery cells 6*a*. This effect occurs in particular towards the end of the low-pressure region, i.e. in particular in a second circumferential portion 13 of the low-pressure region or setting element 10 which adjoins the first circumferential portion 11 in the rotational direction of the delivery rotor 5.

The second circumferential portion 13 is shaped such that a radial flow of the fluid out of the delivery cells 6*a* is impeded or advantageously prevented. In other words, the second circumferential portion 13 impedes or prevents direct fluid communication between the delivery region and the low-pressure inlet 3, in particular the inlet channel 3*b* of the low-pressure inlet 3, in the radial direction. To this end, the axial width $B_2$ of the second circumferential portion 13 corresponds at least substantially to the axial width $B_6$ of the delivery means 6 in advantageous embodiments.

In the example embodiment, the second circumferential portion 13 comprises a cavity 14. The cavity 14 is an axial recess in the second circumferential portion 13. The cavity 14 is open radially inwards, i.e. towards the inner surface area 16 of the setting element 10, and is delineated on the radially outer side by an outer wall of the setting element 10. The setting element 10 axially drops incrementally from the delineating outer wall onto a base of the cavity 14, such that the strip-shaped cavity 14 around the delivery means 6 which pass on the inside is obtained over the length of the second circumferential portion 13 as measured in the circumferential direction.

The cavity 14 extends in the circumferential direction, counter to the rotational direction of the delivery rotor 5, up to the first circumferential portion 11. The cavity 14 is delineated in the rotational direction of the delivery rotor 5 by a wall 14*a*.

The fluid to be delivered can flow from the low-pressure inlet 3 into the cavity 14 via the first circumferential portion 11. The fluid situated in the cavity 14 mainly exhibits a tangential flow direction in relation to the delivery rotor 5. The delivery means 6 which rotate past the cavity 14 accelerate the fluid situated in the cavity 14 in the rotational direction of the delivery rotor 5. However, an outer wall of the setting element 10 which delineates the cavity 14 on the radially outer side holds the fluid back. The fluid accelerated in the cavity 14 is then directed into the delivery region, in particular into the low-pressure region, of the rotary pump 1 in the region of the wall 14*a*. The cavity 14 enables indirect fluid communication between the delivery region and the low-pressure inlet 3 via the second circumferential portion 13. The filling of the delivery cells 6*a* in the second circumferential portion 13 is improved by the cavity 14 which is delineated on the radially outer side by the outer wall of the setting element 10.

The rotary pump 1 comprises a flow channeling structure 22 which is arranged in the low-pressure inlet 3. The flow channeling structure 22 protrudes axially, in relation to the rotational axis D of the delivery rotor 5, from a wall of the pump housing 2 into the low-pressure inlet 3. The flow channeling structure 22 is preferably embodied to influence the fluid flow flowing in the low-pressure inlet 3, in particular the fluid flowing in the inlet channel 3*b*. In the example embodiment, the fluid flow is at least partially redirected by the flow channeling structure 22. A first sub-flow of the fluid is redirected and/or deflected by the flow channeling structure 22 in such a way that the first sub-flow obtains at least a flow direction component which is opposite to the rotational direction of the delivery rotor 5. A second sub-flow of the fluid is redirected and/or deflected by the flow channeling structure 22 in such a way that the second sub-flow obtains at least a flow component which corresponds to the rotational direction of the delivery rotor 5.

The flow channeling structure 22, together with the pump housing 2, forms a first inlet sub-channel 3*c* which is axially open on one side. The first sub-flow of the fluid flow preferably flows through the first inlet sub-channel 3*c* while the rotary pump 1 is in operation. A second inlet sub-channel 3*d* is arranged next to the first inlet sub-channel 3*c* in the rotational direction of the delivery rotor 5. The second inlet sub-channel 3*d* is axially open on one side and is formed by the flow channeling structure 22 and the pump housing 2. The second sub-flow of the fluid preferably flows through the second inlet sub-channel 3*d* while the rotary pump 1 is in operation. In other words, the flow channeling structure 22 protrudes axially into the low-pressure inlet 3 such that it is arranged between the first inlet sub-channel 3*c* and the second inlet sub-channel 3*d*. The flow channeling structure 22 separates the first inlet sub-channel 3*c* from the second inlet sub-channel 3*d* in the circumferential direction.

The flow channeling structure 22 protrudes axially from only one side of the pump housing 2 into the low-pressure inlet 3, i.e. it does not extend over the full axial width of the low-pressure inlet 3. Fluid can therefore also flow across the flow channeling structure 22. The flow channeling structure 22 could however in principle also axially extend almost completely through the low-pressure inlet 3.

The first circumferential portion 11 is arranged axially next to and/or in the first inlet sub-channel 3*c* in any position of the setting element 10. The second circumferential portion 13 is arranged axially next to and/or in the second inlet sub-channel 3*d* in any position of the setting element 10. The transition 15 is arranged axially next to the flow channeling structure 22 and/or axially next to the second inlet sub-channel 3*d* in any position of the setting element 10. Alternatively, or additionally, the transition 15 can be arranged radially next to the flow channeling structure 22 and/or in the second inlet sub-channel 3*d* in any position of the setting element 10.

For translationally adjusting the setting element 10, the setting element 10 comprises multiple sealing sliding surfaces 18, 19. Each sealing sliding surface 18, 19 respectively abuts a sliding surface 8, 9 of the pump housing 2. If the setting element 10 is adjusted, the sealing sliding surfaces 18, 19 slide along the respective sliding surface 8, 9. The sealing sliding surfaces 18, 19 comprise sealing edges 18*a*, 19*a* which face the low-pressure inlet 3. The sealing edges

18*a*, 19*a* seal off the low-pressure inlet 3 at the transition from the pump housing 2 to the setting element 10.

Figure 3:
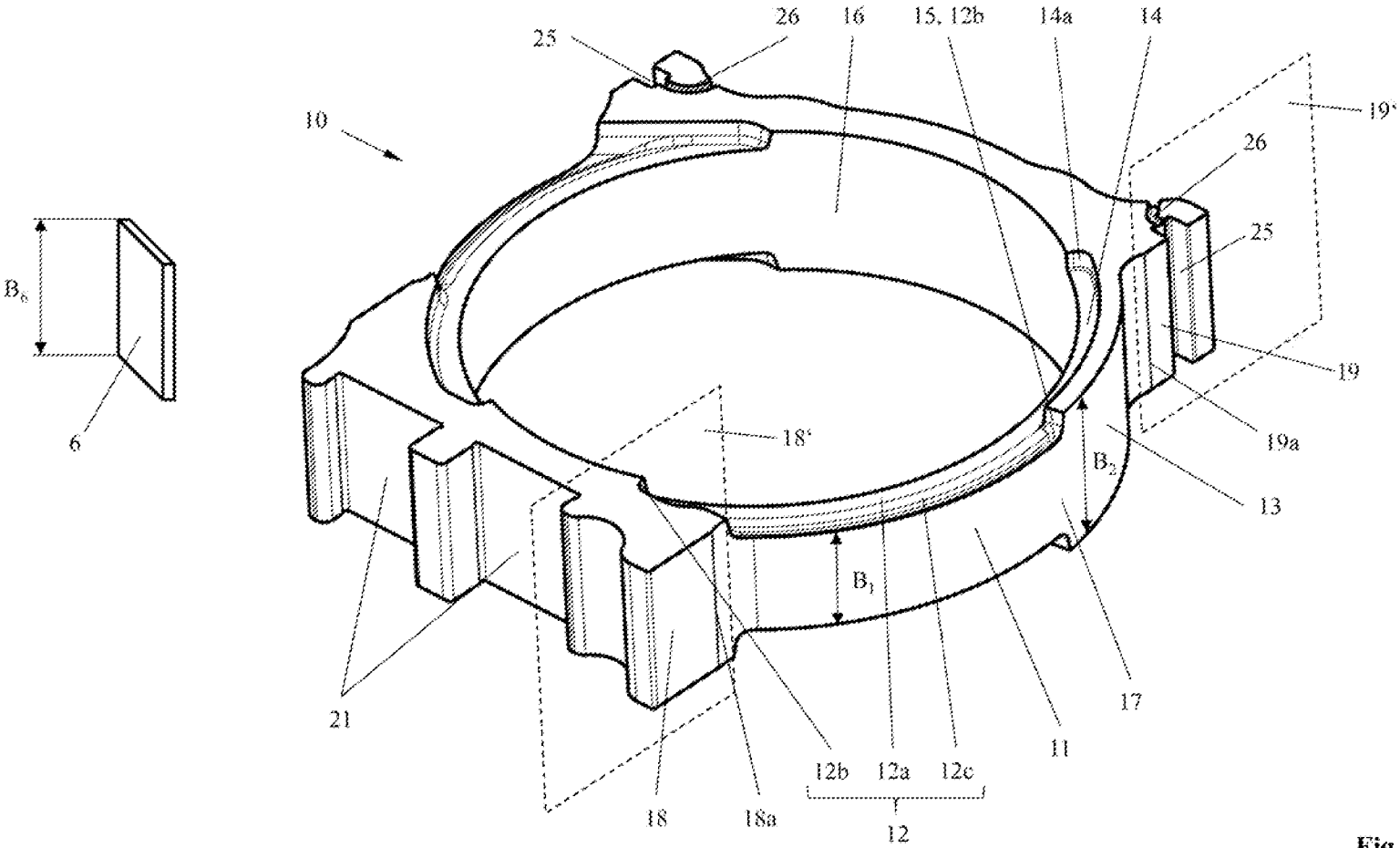
FIG. 3 a perspective representation of a setting element of the example embodiment shown in FIG. 1.

In the example embodiment shown in FIG. 1, the setting element 10 comprises a first sealing sliding surface 18 comprising a first sealing edge 18*a* (FIG. 3). The first sealing sliding surface 18 abuts a first sliding surface 8 of the pump housing 2. A second sealing sliding surface 19 of the setting element 10 comprises a second sealing edge 19*a*. The second sealing sliding surface 19 abuts a second sliding surface 9 of the pump housing 2. The first sealing sliding surface 18 is arranged circumferentially next to the first circumferential portion counter to the rotational direction of the delivery rotor 5. The second sealing sliding surface 19 is arranged circumferentially next to the second circumferential portion 13 in the rotational direction of the delivery rotor 5.

The transition 15 has a distance from the first sealing edge 18*a* as measured in the circumferential direction which is greater than or equal to a distance from the second sealing edge 19*a* as measured in the circumferential direction. In the example embodiment shown in FIG. 1, the distance between the transition 15 and the first sealing edge 18*a* as measured in the circumferential direction is greater than the distance between the transition 15 and the second sealing edge 19*a* as measured in the circumferential direction.

The distance between the transition 15 and the first sealing edge 18*a* as measured in the circumferential direction is greater than the maximum circumferential extent of two adjacent delivery cells 6*a*. In other words, the distance between the transition 15 and the first sealing edge 18*a* as measured in the circumferential direction is greater than the maximum circumferential distance between the two outermost delivery means 6 of a total of three adjacent delivery means 6. Irrespective of this, the distance between the transition 15 and the first sealing edge 18*a* as measured in the circumferential direction is smaller than the maximum circumferential extent of three adjacent delivery cells 6*a*. The distance between the transition 15 and the first sealing edge 18*a* as measured in the circumferential direction is smaller than the maximum circumferential distance between the two outermost delivery means 6 of a total of four adjacent delivery means 6.

The distance between the transition 15 and the second sealing edge 19*a* as measured in the circumferential direction is greater than the maximum circumferential extent of a delivery cell 6*a*. In other words, the distance between the transition 15 and the second sealing edge 19*a* as measured in the circumferential direction is greater than the maximum circumferential distance between two adjacent delivery means 6. Irrespective of this, the distance between the transition 15 and the second sealing edge 19*a* as measured in the circumferential direction is smaller than the maximum circumferential extent of two adjacent delivery cells 6*a*. The distance between the transition 15 and the second sealing edge 19*a* as measured in the circumferential direction is smaller than the maximum circumferential distance between the two outermost delivery means 6 of a total of three adjacent delivery means 6.

The first sealing sliding surface 18 preferably spans a first imaginary plane 18', and the second sealing sliding surface 19 spans a second imaginary plane 19' both shown in FIG. 3. The two imaginary planes 18' and 19' extend parallel to each other in the movement direction of the setting element 10. In the example embodiment, the second imaginary plane 19' is offset in parallel in relation to the first imaginary plane 18'. The second imaginary plane 19' in particular exhibits an orthogonal distance from the rotational axis D which is greater than the orthogonal distance between the first imaginary plane 18' and the rotational axis D. In alternative example embodiments, the two planes 18' and 19' can however also be arranged congruently with each other. Both imaginary planes 18' and 19' extend between the rotational axis D of the delivery rotor 5 and the transition 15 in any position of the setting element 10.

Figure 2:
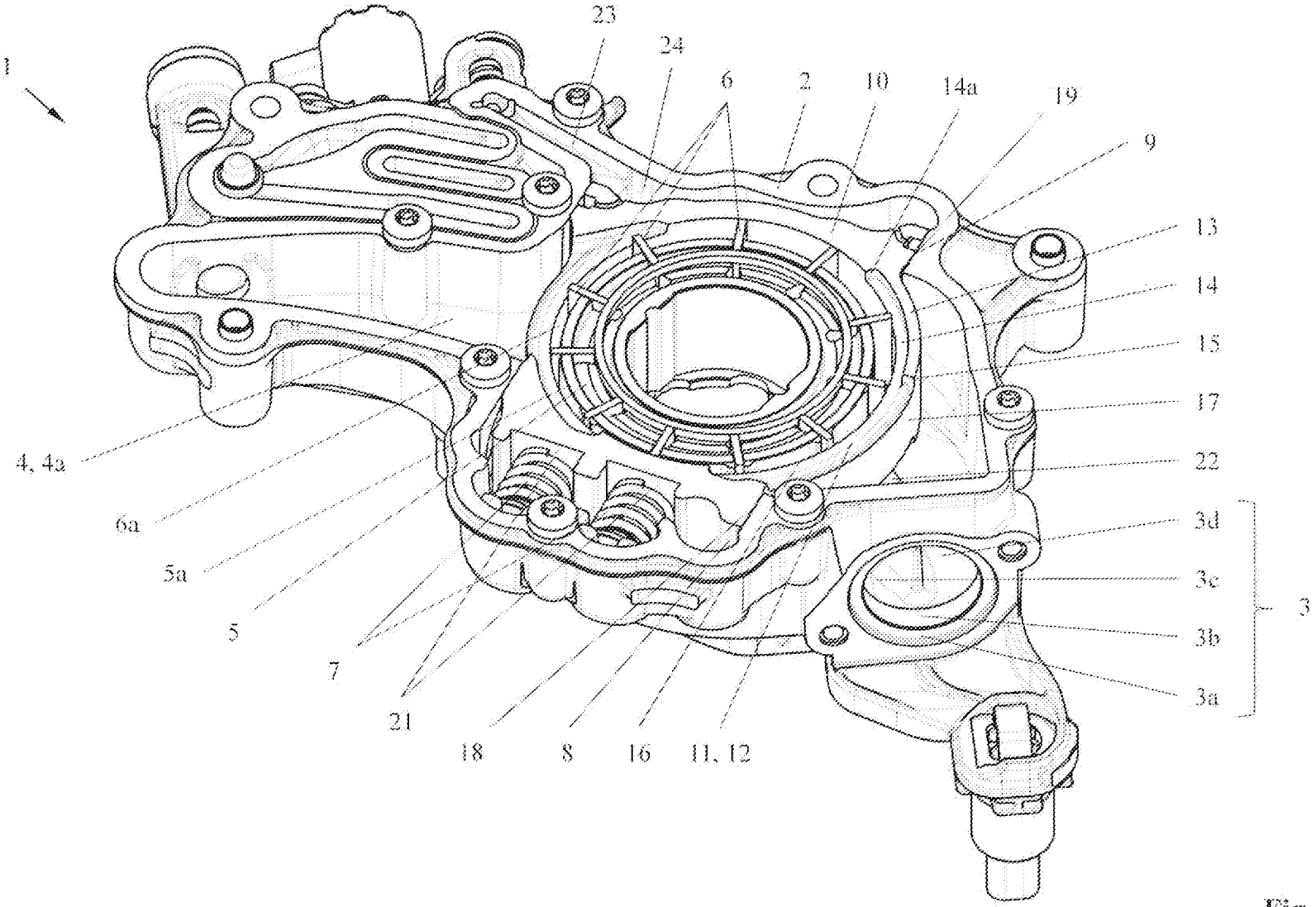
FIG. 2 a perspective representation of the sectional representation shown in FIG. 1.

For better comprehension, the sectional representation of the rotary pump 1 shown in FIG. 1 is shown in a perspective representation in FIG. 2. For an explanation of the structure and functionality of the rotary pump 1 depicted in FIG. 2, reference is made to the statements made above.

FIG. 3 shows a perspective representation of the setting element 10 of the example embodiment. The setting element 10 can however also be used in other rotary pumps having an adjustable delivery volume. The setting element 10 preferably consists of one part and can in particular be molded in one piece.

The setting element 10 is delineated on the radially outer side by an outer surface area 17 and on the radially inner side by an inner surface area 16. Two pressure surfaces 21 are also embodied on the setting element 10, on each of which a restoring means 7 of the rotary pump 1 can be supported (the restoring means 7 not being shown in FIG. 3). In alternative embodiments, the setting element 10 can also comprise only one pressure surface 21 or more than two pressure surfaces 21.

The first sealing sliding surface 18 and the second sealing sliding surface 19 are visible in the perspective view shown in FIG. 3. The setting element 10 comprises two other sealing sliding surfaces, which are preferably each embodied in a similar way to the first sealing sliding surface 18 and the second sealing sliding surface 19, on the opposite side of the setting element 10, i.e. on the side of the high-pressure outlet.

The edge of the first sealing sliding surface 18 which faces the first circumferential portion 11 forms the first sealing edge 18*a*. The edge of the second sealing sliding surface 19 which faces the second circumferential portion 13 forms the second sealing edge 19*a*.

The first circumferential portion 11 exhibits an axial width $B_1$ which is smaller than the axial width $B_2$ of the second circumferential portion 13. The first circumferential portion 11 is separated from the second circumferential portion 13 in the circumferential direction by the transition 15.

The first circumferential portion 11 is formed by at least one recess 12 or, as in the example embodiment shown, by two axially opposing recesses 12. The recess 12 comprises a recess base 12*a*. The edge 12*c* which connects the outer surface area 17 to the recess base 12*a* is preferably rounded and/or exhibits a radius. A rounded edge 12*c* causes a less turbulent radial flow of the fluid to be delivered from the low-pressure inlet 3 into the delivery region of the rotary pump 1. The recess base 12*a* is respectively delineated in the circumferential direction by a recess wall 12*b*. The recess wall 12*b* arranged in the rotational direction of the delivery rotor 5 simultaneously forms the transition 15.

The transition 15 is a collar 15 of the setting element 10. The collar 15 extends perpendicularly from the first circumferential portion 11, in particular from the recess base 12*a*, in the axial direction.

The second circumferential portion 13, which is adjacent in the rotational direction of the delivery rotor 5, exhibits a width $B_2$ which corresponds to the axial width $B_6$ of the delivery means 6. The second circumferential portion 13 comprises a cavity 14 on the side of the inner surface area 16. The cavity 14 extends in the circumferential direction from the first circumferential portion 11 and/or from the transition 15 up to a wall 14*a*.

In the example embodiment of the setting element 10 shown in FIG. 3, a pressure cavity 25 is provided in the second sealing sliding surface 19. When the setting element 10 is installed, the pressure cavity 25 is connected in fluid communication with the pressure chamber 24 via a channel 26.

Figure 4:
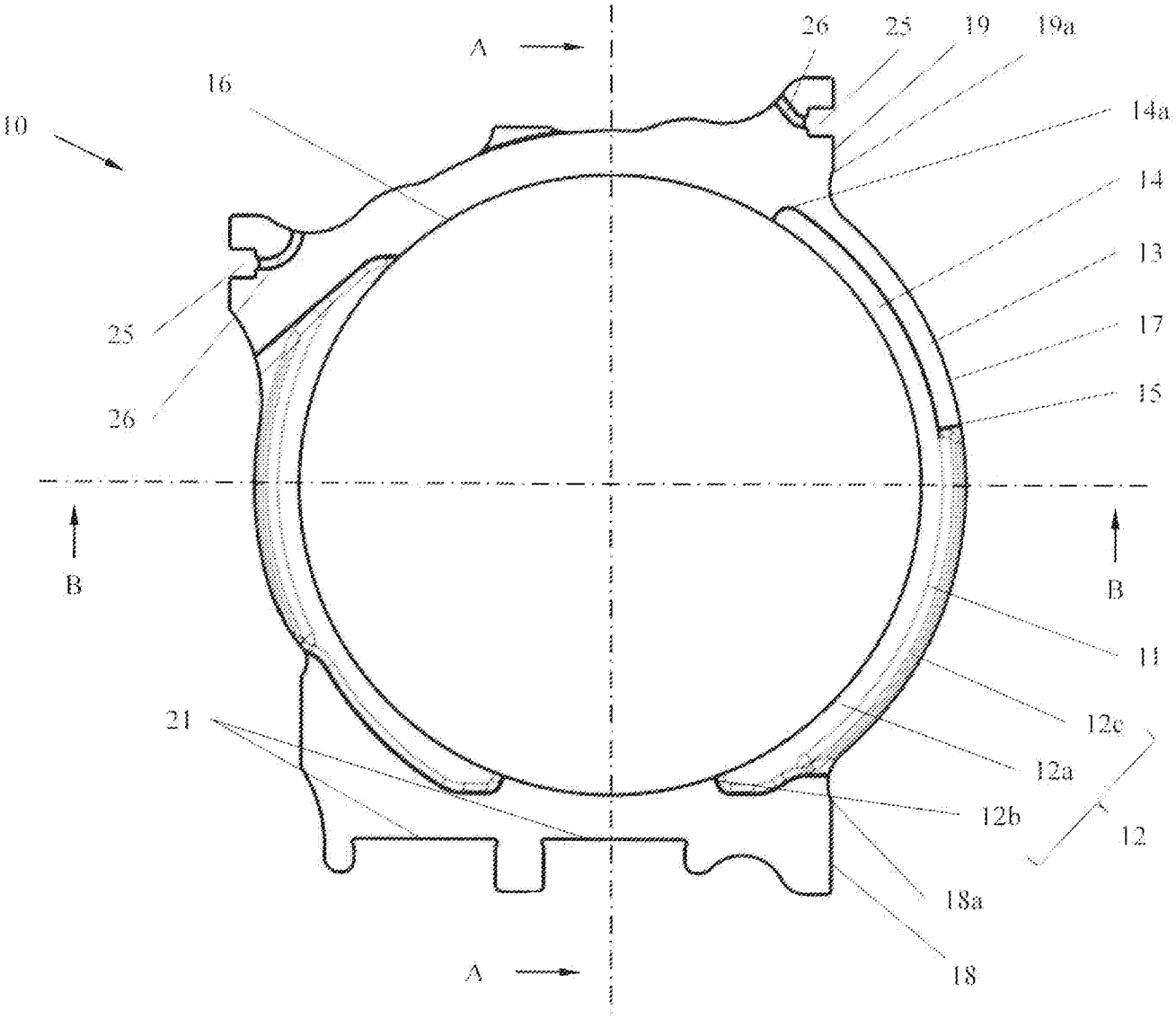
FIG. 4 a plan view of the setting element shown in FIG. 3.
Figure 6:
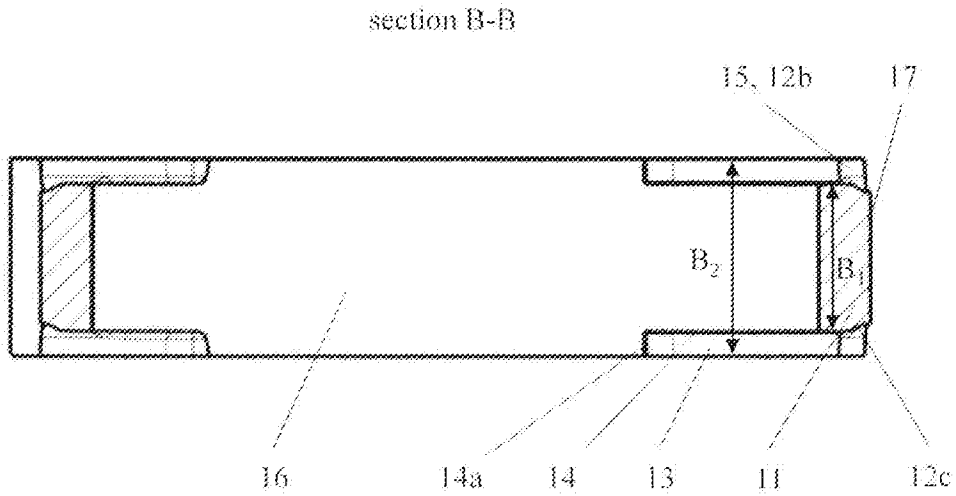
FIG. 6 a second sectional representation of the setting element shown in FIG. 3.
Figure 5:
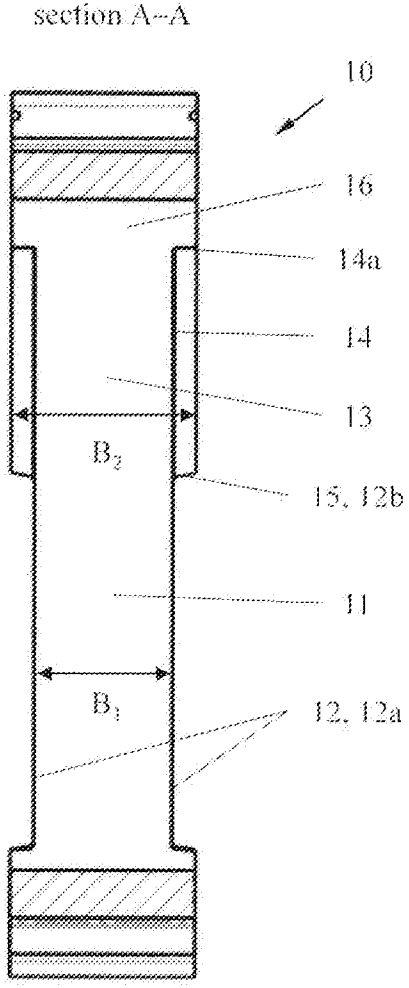
FIG. 5 a first sectional representation of the setting element shown in FIG. 3.

For better comprehension, the setting element 10 is shown in a plan view in FIG. 4. FIG. 5 and FIG. 6 show the sections of the setting element 10 indicated in FIG. 4. With regard to the specific structure of the setting element 10, reference is made to the statements made above.

Figure 7:
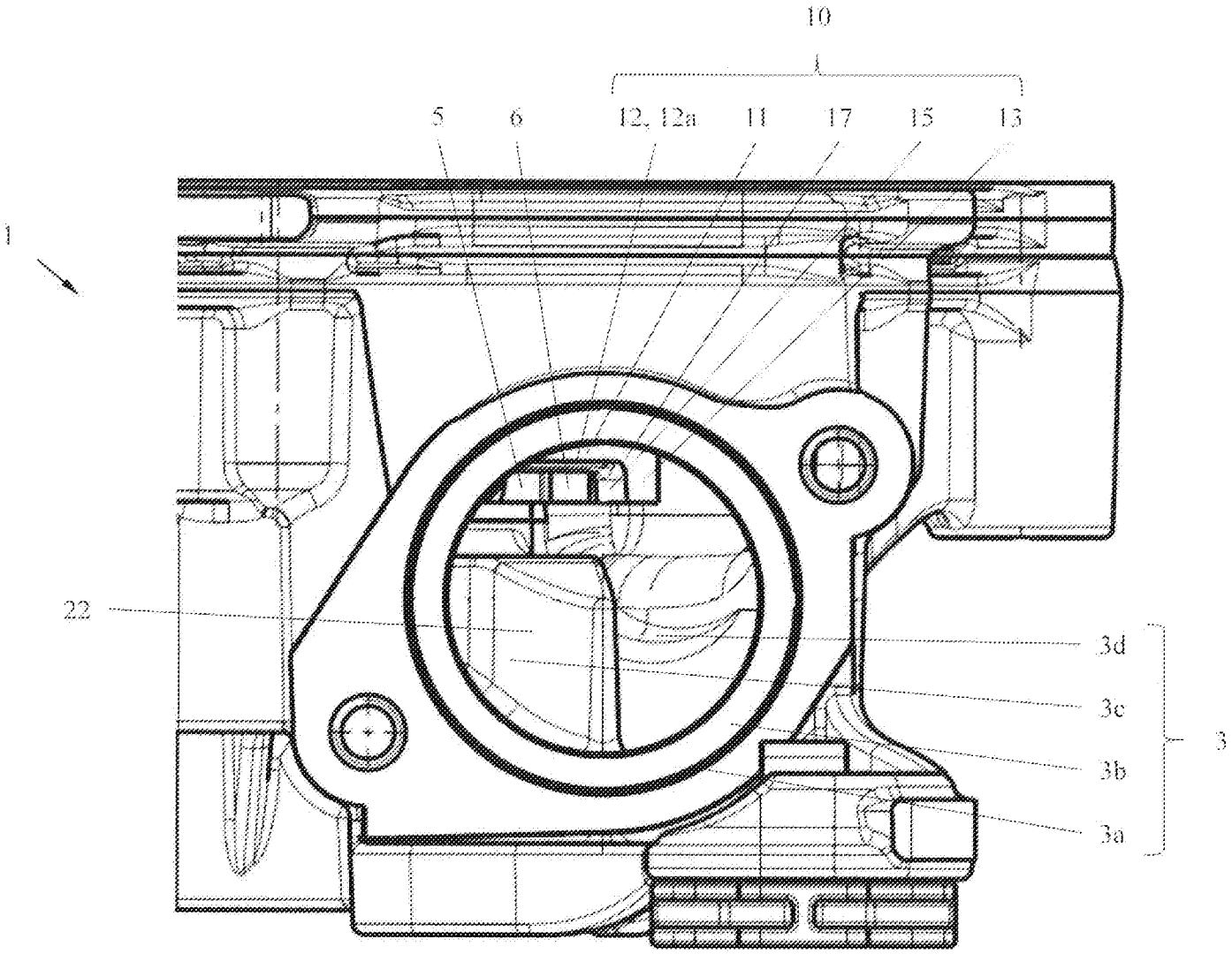
FIG. 7 a detail of a lateral view of the example embodiment shown in FIG. 1.

FIG. 7 shows a detail of a lateral view of the rotary pump 1. In the detail shown in FIG. 7, the viewer is looking into the pump housing 2 through the low-pressure inlet 3 in the flow direction of the fluid to be delivered.

The fluid to be delivered enters the inlet channel 3*b* of the low-pressure inlet 3 via the fluid port 3*a*. A first part of the inflowing fluid can flow directly, preferably in the radial direction, towards the setting element 10, in particular towards the outer surface area 17 of the setting element 10. The fluid can flow into the delivery region, in particular radially or at least with a radial direction component, via the first circumferential portion 11 and delivered by the delivery means 6.

The second circumferential portion 13 adjoins the first circumferential portion 11 in the rotational direction of the delivery rotor 5. The second circumferential portion 13 exhibits an axial width which corresponds to the axial width of the delivery means 6. The second circumferential portion 13 thus advantageously prevents the fluid to be delivered from being able to flow radially back out of the delivery region due to the increasing centrifugal force.

A second part of the inflowing fluid hits the flow channeling structure 22. The flow channeling structure 22 directs a sub-flow of the second part of the fluid into the first inlet sub-channel 3*c*. Another sub-flow of the second part of the fluid is directed into the second inlet sub-channel 3*d* by the flow channeling structure 22.

In the example embodiment, the first circumferential portion 11 is arranged axially next to and in particular also axially above the first inlet sub-channel 3*c* in any position of the setting element 10. The second circumferential portion 13 is arranged axially next to and in particular also axially above the second inlet sub-channel 3*d* in any position of the setting element 10. Depending on the position of the setting element 10, the transition 15 is arranged axially next to and in particular axially above either the flow channeling structure 22 and/or the second inlet sub-channel 3*d*.

REFERENCE SIGNS

| | |
|---|---|
| 1 | rotary pump |
| 2 | pump housing |
| 3 | low-pressure inlet |
| 3a | fluid port |
| 3b | inlet channel |
| 3c | first inlet sub-channel |
| 3d | second inlet sub-channel |
| 4 | high-pressure outlet |
| 4a | outlet channel |
| 5 | delivery rotor |
| 5a | outer surface area |
| 6 | delivery means |
| 6a | delivery cells |

-continued

| | |
|---|---|
| 7 | restoring means |
| 8 | first sliding surface |
| 9 | second sliding surface |
| 10 | setting element |
| 11 | first circumferential portion |
| 12 | recess |
| 12a | recess base |
| 12b | recess wall |
| 12c | edge |
| 13 | second circumferential portion |
| 14 | cavity |
| 14a | wall |
| 15 | transition |
| 16 | inner surface area |
| 17 | outer surface area |
| 18 | first sealing sliding surface |
| 18a | first sealing edge |
| 19 | second sealing sliding surface |
| 19a | second sealing edge |
| 20 | — |
| 21 | pressure surface |
| 22 | flow channeling structure |
| 23 | pressure channel |
| 24 | pressure chamber |
| 25 | pressure recess |
| 26 | channel |
| D | rotational axis |
| $B_1$ | axial width |
| $B_2$ | axial width |
| $B_6$ | axial width |

The invention claimed is:

1. A rotary pump having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the first circumferential portion exhibits a circumferential extent which is smaller than a maximum distance between the two outermost delivery means of a total of four adjacent delivery means as measured in the circumferential direction.

2. The rotary pump according to claim 1, wherein the first circumferential portion and the second circumferential portion are each at least partially arranged radially between the delivery rotor and an inlet channel of the low-pressure inlet.

3. The rotary pump according to claim 1, wherein the transition is a collar of the setting element which is parallel to the rotational axis of the delivery rotor.

4. The rotary pump according to claim 1, wherein an outer surface area of the delivery rotor, an inner surface area of the setting element and the axial outer edges of the delivery means define a delivery region of the rotary pump while the rotary pump is in operation, and the delivery region is connected in direct fluid communication with the low-pressure inlet via the first circumferential portion in the radial direction, and the second circumferential portion prevents direct fluid communication between the delivery region and the low-pressure inlet in the radial direction.

5. The rotary pump according to claim 4, wherein the delivery region comprises a low-pressure region into which the fluid to be delivered flows, wherein the first circumferential portion is arranged at the beginning of the low-pressure region in the rotational direction of the delivery rotor and extends over less than 70% of the circumferential extent of the low-pressure region in any position of the setting element.

6. The rotary pump according to claim 5, wherein the first circumferential portion extends over less than 60% of the circumferential extent of the low-pressure region in any position of the setting element.

7. The rotary pump according to claim 1, wherein the setting element comprises a first sealing sliding surface, which is in sliding contact with the pump housing and is provided next to the first circumferential portion, and a second sealing sliding surface which is in sliding contact with the pump housing and is provided next to the second circumferential portion, wherein the first sealing sliding surface and the second sealing sliding surface slide along the pump housing when the setting element is translationally adjusted.

8. The rotary pump according to claim 7, wherein the first sealing sliding surface defines a first imaginary plane, and the second sealing sliding surface defines a second imaginary plane, wherein the first imaginary plane is embodied to be parallel to the second imaginary plane, and both planes extend between the rotational axis of the delivery rotor and the transition in each position of the setting element.

9. The rotary pump according to claim 8, wherein the first imaginary plane and the second imaginary plane neither intersect nor are tangential to the transition from the first circumferential portion to the second circumferential portion.

10. The rotary pump according to claim 1, wherein the first circumferential portion is formed by a radially continuous, axial recess in the setting element.

11. The rotary pump according to claim 1, wherein the axial width of the second circumferential portion corresponds to or is smaller than the axial width of the delivery means.

12. A rotary pump having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the setting element comprises a first sealing sliding surface, which is in sliding contact with the pump housing and is provided next to the first circumferential portion, and a second sealing sliding surface which is in sliding contact with the pump housing and is provided next to the second circumferential portion, wherein the first sealing sliding surface and the second sealing sliding surface slide along the pump housing when the setting element is translationally adjusted, and wherein the first sealing sliding surface comprises a first sealing edge at an end facing the second sealing sliding surface, and the second sealing sliding surface comprises a second sealing edge at an end facing the first sealing sliding surface, and each of the first sealing edge and the second sealing edge each seal off the low-pressure inlet at the transition in the sliding contact between the pump housing and the setting element, wherein the transition exhibits a distance from each of the first sealing edge and the second sealing edge as measured in the circumferential direction, in the rotational direction of the delivery rotor, which is greater than or equal to a maximum distance between two adjacent delivery means as measured in the circumferential direction in the rotational direction of the delivery rotor.

13. A rotary pump having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the setting element comprises a first sealing sliding surface, which is in sliding contact with the pump housing and is provided next to the first circumferential portion, and a second sealing sliding surface which is in sliding contact with the pump housing and is provided next to the second circumferential portion, wherein the first sealing sliding surface and the second sealing sliding surface slide along the pump housing when the setting element is translationally adjusted, and wherein the first sealing sliding surface comprises a first sealing edge at an end facing the second sealing sliding surface, and the second sealing sliding surface comprises a second sealing edge at an end facing the first sealing sliding surface, and each of the first sealing edge and the second sealing edge each seal off the low-pressure inlet at the transition in the sliding contact between the pump housing and the setting element, and wherein the transition exhibits a distance from the first sealing edge as measured in the circumferential direction, in the rotational direction of the delivery rotor, which is greater than or equal to a distance from the second sealing edge as measured in the circumferential direction.

14. A rotary pump according having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the first circumferential portion and the second circumferential portion exhibit a circumferential extent which corresponds to at least a maximum distance between two adjacent delivery means as measured in the circumferential direction in the rotational direction of the delivery rotor.

15. A rotary pump having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the first circumferential portion is formed by a radially continuous, axial recess in the setting element, and wherein the axial recess comprises a recess base which is delineated in the circumferential direction by two opposing recess walls, and one of the recess walls forms the transition.

16. A rotary pump having an adjustable delivery volume, the rotary pump comprising:

(a) a pump housing having a low-pressure inlet and a high-pressure outlet for a fluid to be delivered; and (b) a delivery rotor arranged such that it is rotatable about a rotational axis in the pump housing and comprising multiple delivery means which are distributed over a circumference of the delivery rotor for delivering the fluid from the low-pressure inlet to the high-pressure outlet; and (c) a setting element which is adapted to be translationally moved back and forth in relation to the pump housing for adjusting the delivery volume of the rotary pump, wherein (d) an inlet end of the setting element comprises:

(d1) a first circumferential portion which extends circumferentially in a rotational direction of the delivery rotor and an axial width of which is smaller than an axial width of the delivery means and (d2) a second circumferential portion which adjoins the first circumferential portion in the rotational direction of the delivery rotor and an axial width of which is greater than the axial width of the first circumferential portion, wherein (e) a transition, in the rotational direction of the delivery rotor, from the first circumferential portion to the second circumferential portion is arranged in the low-pressure inlet in each position of the setting element, wherein the axial width of the second circumferential portion corresponds to or is smaller than the axial width of the delivery means, wherein the second circumferential portion comprises a cavity which is radially open towards the delivery rotor and is not axially continuous, and the cavity exhibits a circumferential extent, from the first circumferential portion in the rotational direction of the delivery rotor, which at most corresponds to a maximum distance between two adjacent delivery means as measured in the circumferential direction.

* * * * *